US005429176A

United States Patent [19]

Atkinson et al.

[11] Patent Number: 5,429,176

[45] Date of Patent: Jul. 4, 1995

[54] THERMAL RADIATION BAFFLE FOR APPARATUS FOR USE IN DIRECTIONAL SOLIDIFICATION

[75] Inventors: Alan W. Atkinson, Rugby; Melanie J. Walsh, Northants, both of United Kingdom

[73] Assignee: T&N Technology Limited, Warwickshire, England

[21] Appl. No.: 308,208

[22] Filed: Sep. 19, 1994

Related U.S. Application Data

[63] Continuation of Ser. No. 120,393, Sep. 13, 1993, abandoned.

[30] Foreign Application Priority Data

Sep. 25, 1992 [GB] United Kingdom ..... 9220329

[51] Int. Cl.[6] ..... B22D 27/04

[52] U.S. Cl. ..... 164/412; 164/338.1; 164/122.1; 366/903; 432/251

[58] Field of Search ..... 164/122.1, 122.2, 125, 164/338.1, 412; 266/903; 432/251

[56] References Cited

U.S. PATENT DOCUMENTS

| | | | |
|---|---|---|---|
| 3,714,977 | 2/1973 | Terkelsen | 164/125 |
| 3,841,384 | 10/1974 | Tingquist et al. . | |
| 4,108,236 | 8/1978 | Salkeld | 164/122.1 |
| 4,353,688 | 10/1982 | Ahner | 432/217 |
| 4,757,856 | 7/1988 | George | 164/122.1 |
| 4,773,467 | 9/1988 | Graham et al. . | |
| 4,969,501 | 11/1990 | Brokloff | 164/338.1 |
| 5,013,393 | 5/1991 | Schwirtlich et al. . | |
| 5,066,223 | 11/1991 | Mosch . | |

FOREIGN PATENT DOCUMENTS

| | | | |
|---|---|---|---|
| 0218087 | 4/1987 | European Pat. Off. . | |
| 0289393 | 11/1988 | European Pat. Off. | 164/338.1 |
| 1095587 | 12/1967 | United Kingdom | 164/122.1 |

OTHER PUBLICATIONS

Part III Engineering Materials, The Science & Engineering of Materials, by Donald R. Askeland, Jun. 1989 pp. 519, 525.

*Primary Examiner*—Kuang Y. Lin
*Attorney, Agent, or Firm*—Nixon & Vanderhye

[57] ABSTRACT

A thermal radiation baffle for apparatus for use in directional solidification of crystalline material, to be mounted at one end of a furnace, and to allow a mould containing the material in molten form to pass through, has at least one clamped layer of interconnected flexible strips of refractory material. Each such layer has an ordered construction, for example, with the strips being interwoven, or knitted; and has one or more slits therein. At least substantially the whole of each slit is inclined at a significant angle to the strips, so that the strips do not become detached or worn in use, but the layer is capable of resiliently engaging the sides of, for example, an irregularly shaped mould. A slit may be provided between two separate, but adjacent, pieces of the layer.

15 Claims, 1 Drawing Sheet

THERMAL RADIATION BAFFLE FOR APPARATUS FOR USE IN DIRECTIONAL SOLIDIFICATION

This application is a continuation of Ser. No. 120,393 filed Sep. 13, 1993, now abandoned.

BACKGROUND OF THE INVENTION

This invention relates to a thermal radiation baffle for apparatus for use in the directional solidification of crystalline material, in particular, to obtain high strength articles of metal alloys.

In one general form for such apparatus a furnace, in which molten material is poured into a mould to cast the required article, is mounted vertically above means for rapidly cooling the molten material in the mould. The means for rapidly cooling the molten material may have one of several different constructions. In general, such means comprises a chill plate on which the mould is mounted, and the arrangement associated with the plate is so that heat can be extracted therefrom, and hence also from the mould, at a high rate. The chill plate is movable, in a controlled manner in a vertical direction, and drive means for the plate is provided. The drive means initially causes the mould to be located in the furnace; and then causes the mould to be withdrawn from the furnace, so that the molten material then in the mould is solidified.

It is required for the production of high strength articles by directional solidification that the molten material in the mould should start to solidify at the chill plate. Further, the arrangement is to be so that a sharply defined interface between the solidified and molten material is obtained; and that this interface moves in the required direction of crystallisation of the material. For the general form of apparatus referred to above, this direction of interface movement is opposite to the vertical direction of relative movement of the chill plate and filled mould away from the furnace. The speed of movement of the chill plate can have any desired value; but it is required that heat is removed from the chill plate as quickly as possible; and that the rate of heat supplied to the parts of the mould displaced from the furnace by radiation from the furnace, is as small as possible. In order that the latter criterion is obtained it is known to provide a thermal radiation baffle of a refractory material mounted at the lower end of the furnace, and through which baffle the filled mould is withdrawn. The empty mould is also required to pass through the baffle in the reverse direction.

Many different constructions for such a thermal radiation baffle are known. For example, it is disclosed in U.S. Pat. No. 3,714,977 to provide a layer of shell mould material; with an overlying layer of graphite fibres, this fibre layer having a random construction to comprise a felt; and there being a permanent aperture for the passage of the mould through the centre of the baffle. The two layers are secured together, with the inner periphery of the apertured felt layer extending beyond the corresponding inner periphery of the other layer, substantially into contact with the mould. The felt is flexible to a degree, and the mould may move freely past the edge of the felt layer, this edge being capable of deforming to some extent if necessary, and if contacted by the mould.

It is an object of the present invention to provide a novel and advantageous construction for a thermal radiation baffle for apparatus for use in directional solidification.

SUMMARY OF THE INVENTION

In accordance with the present invention a thermal radiation baffle for apparatus for use in directional solidification of crystalline material, the baffle being mounted at one end of a furnace, and, in use, there is to be a linear relative movement between a mould and the baffle when the mould is to be removed from the furnace, has clamped within the baffle at least one layer of interconnected flexible strips of refractory material, and each such layer comprises an ordered construction of the strips, and has at least one slit therein to enable the mould to pass through the layer with the edges of each slit engaging the mould in a resilient manner, and at least substantially the whole of each slit is inclined at a significant angle to the strips.

The present invention is now described by way of example with reference to the accompanying drawings, in which

DETAIL DESCRIPTION OF THE INVENTION

Figure 1:
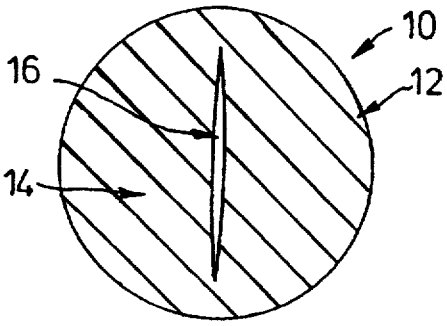
FIG. 1 is a plan view of part of one embodiment of a thermal radiation baffle for apparatus for use in directional solidification of crystalline material, this Figure showing a clamped layer of interconnected flexible strips of refractory material, the layer having an ordered construction, the illustrated layer having interwoven strips, and the layer has a linearly extending slit therein.

The embodiment of a thermal radiation baffle 10 for apparatus for use in directional solidification, and shown partially in FIG. 1, comprises a clamped layer 12 of interwoven strips 14. For convenience, the means for clamping the layer 12, and for mounting the baffle 10 at one end of a furnace, are not shown. In the illustration the warp and weft strips 14 are represented as being at right angles to each other. A linearly extending slit 16 extends at the significant angle of 45° to the strips 14, across the central part (including a vertical center axis)

of the clamped layer 12. The strips 14 are of refractory material.

Figure 2:
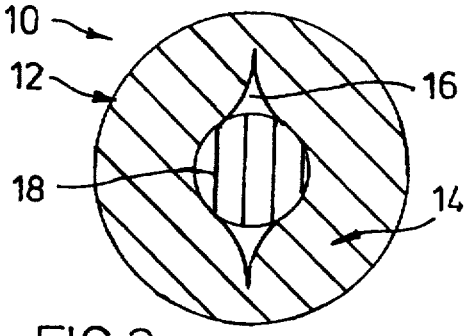
FIG. 2 is a plan view of the layer shown in FIG. 1 when a mould is passing through the slit, FIG. 3 corresponds to FIG. 1, but shows an orthogonal, symmetrical arrangement of two intersecting slits in the layer, FIG. 4 corresponds to FIG. 3, but shows a permanent circular aperture provided at the centre of the orthogonal slits.

Shown in FIG. 2 is a circular section mould 18 passing through the centre of the slit 16 in the layer 12. The slit 16 becomes deformed, and the central part of the slit tends to conform to the shape of the mould 18. At its extremities the slit 16 is opened. However, whilst the baffle 10 is less efficient as a shield for radiation from the furnace when the mould 18 is passing through the slit 16, compared with when the slit 16 is closed, as shown in FIG. 1 the layer 12 does comprise an effective thermal radiation baffle throughout its use.

The interconnected strips have to be of a reasonably flexible material, for example, comprising carbon ribbons reinforced with fibres of carbon, or of a suitable ceramic, or of a suitable refractory metal; or the interconnected strips may be significantly flexible yarns. In this specification, and the accompanying claims, the term yarn is employed to include references to, for example, monofilaments; untwisted rovings; and single, double or multiple strands, which may be twisted. For such yarns the refractory material may be carbon; silicon carbide, alumina, or any suitable ceramic material; or any suitable refractory metal.

In one particular example of a thermal radiation baffle in accordance with the present invention the interconnected strips each comprise a 3000 filament tow of carbon fibre. A layer is produced therefrom by plain weaving warp and weft strips, with 5 strips being provided per centimeter. The layer obtained weighed 200 grams per square meter, and had a thickness of 0.32 millimeters. The thermal radiation baffle produced from the layer had a disc of this material approximately 500 millimeters in diameter, and within this disc was a linear slit approximately 250 millimeters long.

Because the layer of the baffle is provided by an ordered arrangement of interconnected strips, and having the slit provided therein inclined at a significant angle to the strips, the baffle is advantageous because it is robust; and the slit readily recloses after being opened by the mould; and the strips do not tend to become detached, or damaged, in use. For this purpose the slit may be inclined in a horizontal plane at any significant angle, greater than, or equal to, 10° to the strips. In addition, whilst the mould is passing through the baffle, the layer of interconnected strips resiliently engages the mould. The arrangement may be such that ends of the strips protrude into re-entrant parts of an irregular shaped mould to provide a more effective barrier for radiation from the furnace.

Figure 3:
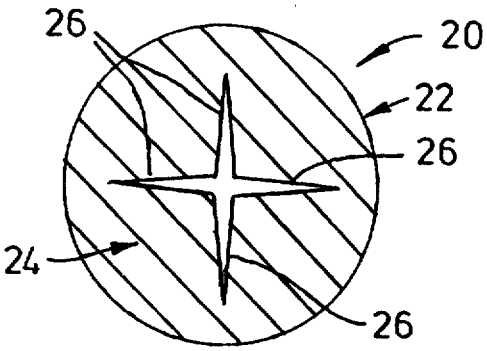

The construction of the thermal radiation baffle 20 shown in FIG. 3 is the same as that of the baffle 10 of FIGS. 1 and 2, except that two orthogonal slits 26 extend across the central part of the clamped layer 22. The warp and weft strips 24 are at right angles to each other, and all these strips are inclined at the significant angle of 45° to both slits 26. This arrangement enables the layer 22 to be a closer fit around the mould than the layer 12 of FIGS. 1 and 2; but the layer 22 is less resilient, and the slits 26 do not close as easily as the slit 16 in the layer 12.

The, or at least one, slit in the layer of interconnected strips may not extend wholly linearly. If any portion of a slit is inclined at an angle less than an appropriate significant angle to the strips, conveniently, this slit portion does not contact the mould, so that strips providing this slit portion do not become frayed or detached.

Figure 4:
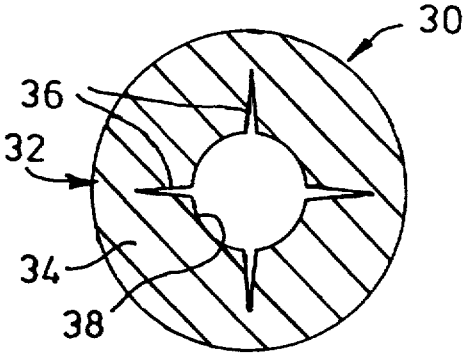

The baffle 30 shown in FIG. 4 is to be employed with a particular mould, and a permanent aperture 38 is provided therein. This permanent aperture 38 corresponds to the smallest cross-sectional shape of the mould with respect to the axis of relative movement of the mould and the baffle 30. The permanent aperture 38 is in the central part of the layer 32 of the baffle. Otherwise the baffle 30 has the same construction as the baffle 20 shown in FIG. 3, having two orthogonal slits 36 inclined at the significant angle of 45° to the warp and weft strips 34. This arrangement is particularly useful when large moulds are employed, and facilitates the layer 32 being a close fit around the mould. However, inherently more radiation passes through the baffle 30 when the mould is not passing through the baffle, compared with the amount of radiation passed by the baffle 20 of FIG. 3.

Figure 5:
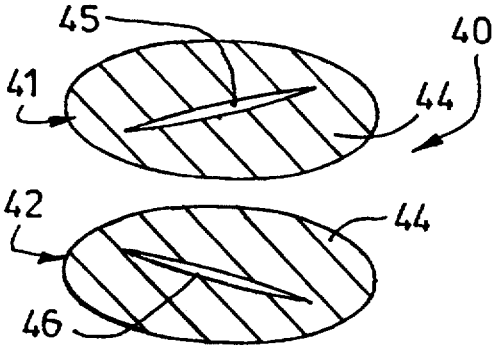
FIG. 5 is an exploded view of part of a baffle having two clamped layers of interwoven strips, each constituent layer having the construction shown in FIG. 1 with a single linearly extending slit therein, in this baffle the two layers being arranged with the slits orthogonal, FIG. 6 corresponds to FIG. 2, but is a plan view of the baffle of FIG. 5 when a mould is passing through the slits.
Figure 6:
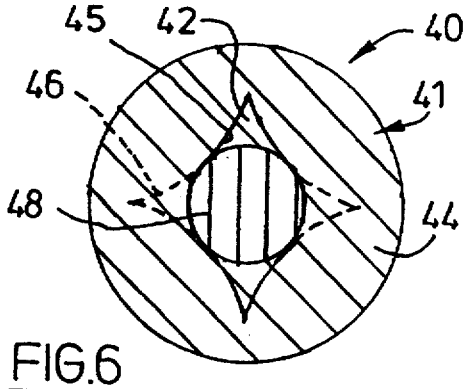

The thermal radiation baffle 40 shown in FIGS. 5 and 6 comprises two layers 41 and 42 of interwoven strips 44, the layers being clamped in contact with each other. Each layer 41 or 42 has the same construction as the layer 12 of the baffle 10 of FIG. 1, having therein a linearly extending slit, respectively, 45 or 46. In the assembled baffle 40 the two layers 41 and 42 are orientated so that the two slits 45 and 46 are at right angles to each other. Further, as shown in FIG. 6, when the mould 48 is passing through the slits 45 and 46, and the slit 46 in the underlying layer 42 being indicated in dotted line form, substantially the whole of the mould surface is contacted by one or other of the layers 41 and 42. Hence, a more effective thermal radiation baffle is provided than if a single layer having single slit is provided, as shown in FIG. 2. The baffle 40 is also more effective as a radiation shield than if two orthogonal slits 26 are provided in a single layer 22, as shown in FIG. 3.

A conformable baffle in accordance with the present invention can be provided with any appropriate arrangement for the slits in the, or at least one, layer, in order to provide a tight fit continuously with the mould, when the mould is passing therethrough, and possibly with substantially the whole of the periphery of the mould at the level instantaneously contacted by the strips. Such an appropriate arrangement of slits may accommodate a mould of a complex and irregular shape, possibly having varying irregular cross-sectional shapes along its axis parallel to the direction of relative movement between the mould and the baffle. Further, it is not necessary for the arrangement of slits to be symmetrical about the centre of the layer, particularly if the centre of the mould is spaced from the axis of relative movement between the mould and the baffle.

A layer of interwoven strips may have any suitable form, for example, a plain, twill, or satin weave may be used; and the strips may not be orthogonally arranged.

A three-dimensional ordered construction for a layer may be obtained by some of the weft strips extending at right angles to the plane of the layer, in order to join together two or more constituent sets of the warp strips. Alternatively, two or more provided constituent sets of strips may be secured together by stitching, needling or bonding; or by any other convenient method. Such a three-dimensional construction may have both high robustness and high flexibility.

Alternatively, in essentially a two-dimensional construction, more than one warp and/or weft set of strips may be employed, say, to obtain a hexagonal weave.

Further, the, or at least one, layer of interconnected strips, of an appropriate flexibility, and especially when the strips comprise yarns, may have an ordered construction by comprising a knitted layer, particularly, having an interlocked knitted construction.

When a plurality of layers of interconnected strips are provided in a baffle, different layers of interconnected strips may have different, ordered constructions. Thus, for example, one layer has an interwoven construction, whilst another layer has a knitted construction. In addition, or alternatively, one layer comprises flexible yarns, and another layer is of relatively more rigid and brittle strips. In addition, or alternatively, different layers may have different arrangements of slits and/or permanent apertures therein.

In addition to having at least one layer of interconnected strips, with an ordered construction of the strips, a baffle in accordance with the present invention may also have a layer not having such an ordered construction, for example, the additional layer not comprising interconnected strips, but possibly having at least one slit provided therein.

Alternatively, a baffle in accordance with the present invention, in addition to having at least one layer of interconnected strips, with an ordered construction of the strips, and each such layer having at least one slit therein, with at least substantially the whole of each slit inclined at a significant angle to the strips, also has a permanently apertured layer having a similar construction, but not having such a slit.

It may be desirable to have the outer parts of a baffle formed in any convenient manner to be stiffer than the inner parts contacting the mould, in order to prevent undesirable sagging of the baffle.

Figure 7:
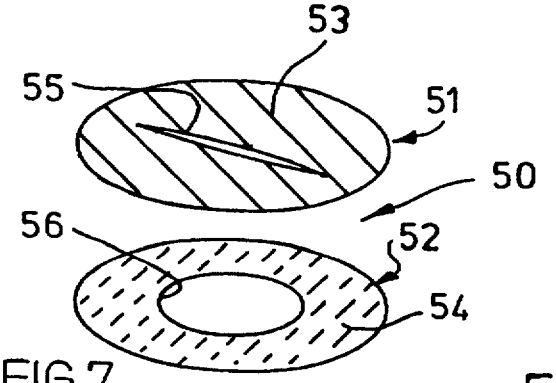
FIG. 7 is an exploded view of a baffle having two clamped layers, one layer is of interwoven flexible strips having a single linearly extending slit therein, and the other, stiffer, layer solely has a permanent aperture therein.

The thermal radiation baffle 50 illustrated in FIG. 7 also has two constituent clamped layers 51 and 52, but the two layers have different constructions, the layer 51 being of interwoven graphite strips 53, and the layer 52 comprising a continuous foil indicated generally at 54. The layer 52 is stiffer than the layer 51. The layer 51 is shown as having a linearly extending slit 55 therein, and has the same construction as the layer 12 of the baffle 10 of FIG. 1. The layer 52 is shown as having solely a circular permanent aperture 56 therethrough, this aperture corresponding to the smallest cross-sectional shape of the mould with respect to the axis of relative movement of the mould and the baffle 50. Whilst the layer 52, considered in isolation, is not constructed in accordance with the present invention, in combination with a layer which is constructed in accordance with the present invention, such as the layer 51, provides a baffle 50 in accordance with the present invention, combining the advantageous resilient flexibility of the layer 51 and the relative stiffness of the layer 52 at the outer parts of the baffle. It is possible that the layer 52 could be formed from interconnected strips.

The outer parts of a baffle remote from the, or each, slit may be selectively stiffened by impregnation of the, or at least one constituent layer with, say, a suitable ceramic cement, or a carbonisable resin.

The, or at least one, clamped layer may have at least one slit provided between two separate pieces of interconnected strips adjacent in the plane of the layer, at each adjacent edge of the pieces the arrangement being such that at least substantially the whole of the slit is inclined at a significant angle to the strips forming the associated pieces.

Figure 8:
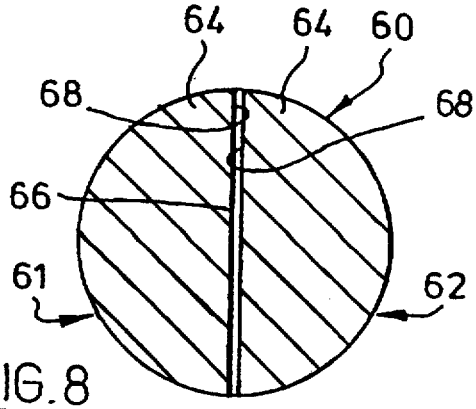
FIG. 8 is a plan view of part of another baffle equivalent to the baffle of FIG. 1 with a linearly extending slit, in this other baffle the clamped layer comprises two separate, but adjacent, pieces of interwoven strips.

Thus, the baffle 60 shown in FIG. 8 has the equivalent construction to that of the baffle 10 shown in FIG. 1, however the clamped layer comprises two separate, adjacent pieces 61 and 62 of interwoven strips 64. Between the two pieces is a slit 66 corresponding to the slit 16 of the baffle 10 of FIG. 1, but the slit 66 extends linearly across the whole of the composite clamped layer. Abutting edges 68 of the two pieces 61 and 62 form the slit 66, and extend at the significant angle of 45° to all the interwoven strips 64 forming the pieces 61 and 62. Instead of abutting, the two adjacent edges 68 of the pieces 61 and 62 may be in overlapping relationship with each other. However, there can be considered to be an effective slit in accordance with the present invention between the two pieces 61 and 62.

We claim:

1. A thermal radiation baffle for apparatus for use in directional solidification of crystalline material, tile baffle adapted the mounting at one end of a furnace such as to enable linear relative movement between a mould and the baffle when the mould is to be removed from the furnace, the baffle comprising at least one substantially horizontal layer of interconnected flexible warp and weft strips of refractory material, each such layer comprising and ordered construction of said flexible warp and weft strips, with at least one elongated slit therein traversing a vertical center axis of the baffle to thereby enable the mould to pass through the layer with edges of each slit engaging the mould in a resilient manner, and wherein said at least one elongated slit is inclined in a horizontal plane at an angle of at least 10° to said flexible warp and weft strips.

2. A baffle as claimed in claim 1, in which said at least one layer of interconnected flexible warp and weft strips comprises interwoven strips.

3. A baffle as claimed in claim 1 in which said at least one layer of interconnected flexible warp and weft strips comprise yarns.

4. A baffle as claimed in claim 3, in which said at least one layer of interconnected flexible warp and weft strips comprises knitted yarns.

5. A baffle as claimed in claim 1, in which said at least one elongated slit in a layer of interconnected flexible warp and weft strips extends wholly linearly.

6. A baffle as claimed in claim 2, in which said interconnected flexible warp and weft strips are orthogonally interwoven, and each linearly extending part of each slit is inclined at an angle of substantially 45° to all of said interconnected flexible warp and weft strips.

7. A baffle as claimed in claim 1, in which a plurality of layers of interconnected flexible warp and weft strips are provided, and different layers have different, ordered constructions.

8. A baffle as claimed in claim 1, in which, in addition to having at least one layer of interconnected flexible warp and weft strips, with an ordered construction of said strips, there is provided a layer not having such an ordered construction.

9. A baffle as claimed in claim 1, in which, in addition to having at least one layer of interconnected flexible warp and weft strips, with an ordered construction of said strips, and each such layer having at least one slit therein, with at least substantially the whole of each slit inclined at an angle to all of said strips, there is also provided a permanently apertured layer having a similar construction, but not having such a slit.

10. A thermal radiation baffle for apparatus for use in directional solidification of crystalline material, the baffle adapted for mounting at one end of a furnace such as to enable linear relative movement between a mould and tile baffle when the mould is to be removed from the furnace, the baffle comprising: at least one substantially horizontal layer of interconnected flexible warp and weft strips of refractory material, each such layer comprising an ordered construction of said interconnected flexible warp and weft strips, with at least one elongated slit therein traversing a center axis of the baffle to thereby enable the mould to pass through the layer with edges of each slit engaging the mould in a resilient manner, and wherein said at least one elongated slit is inclined in a horizontal plane at an angle of at least 10° to said interconnected flexible warp and weft strips; and in which a plurality of layers of interconnected flexible warp and weft strips are provided, and tile elongated slits in a plurality of layers are not aligned with each other.

11. A thermal radiation baffle for apparatus for use in directional solidification of crystalline material, tile baffle adapted for mounting at one end of a furnace such as to enable linear relative movement between a mould and the baffle when the mould is to be removed from the furnace, the baffle comprising: at least one substantially horizontal layer of interconnected flexible warp and weft strips of refractory material, said at least one substantially horizontal layer comprising an ordered construction of said flexible warp and weft strips, with at least one elongated slit therein traversing a vertical center axis of the baffle to thereby enable the mould to pass through the layer with edges of each slit engaging the mould in a resilient manner, and wherein said at least one elongated slit is inclined in a horizontal plane at an angle of at least 10° to said interconnected flexible warp and weft strips; and in which said at least one slit which is provided between two separate pieces of interconnected flexible warp and weft strips adjacent each other in the plane of the layer, each adjacent edge of said two separate pieces forming the arranged such that at least substantially the whole of the slit is inclined at an angle to the interconnected flexible warp and weft strips forming the associated pieces.

12. A baffle as claimed in claim 10, in which the adjacent edges of the pieces abut each other.

13. A baffle as claimed in claim 10, in which the adjacent edges of the pieces are in overlapping relationship with each other.

14. A thermal radiation baffle for apparatus for use in directional solidification of crystalline material, the baffle adapted for mounting at one end of a furnace such as to enable linear relative movement between a mould and the baffle when the mould is to be removed from the furnace, the baffle comprising: at least one substantially horizontal layer of interconnected flexible warp and weft strips of refractory material, each such layer comprising an ordered construction of said flexible warp and weft strips, with at least one elongated slit therein to thereby enable the mould to pass through the layer with edges of each slit engaging the mould in a resilient manner, and wherein said at least one elongated slit is inclined in a horizontal plane at an angle of at least 10° to said flexible warp and weft strips, and wherein said at least one layer of interconnected strips is provided with a permanent aperture, in addition to the, or each, slit.

15. A thermal radiation baffle for apparatus for use in directional solidification of crystalline material, the baffle adapted for mounting at one end of a furnace such as to enable linear relative movement between a mould and the baffle when the mould is to be removed from the furnace, the baffle comprising: at least one substantially horizontal layer of interconnected flexible warp and weft strips of refractory material, each such layer comprising an ordered construction of said flexible warp and weft strips, with at least one elongated slit therein to thereby enable the mould to pass through the layer with edges of each slit engaging the mould in a resilient manner, and wherein said at least one elongated slit is inclined in a horizontal plane at an angle of at least 10° to said flexible warp and weft strips.

* * * * *